US007645479B2

(12) United States Patent
Bogue et al.

(10) Patent No.: US 7,645,479 B2
(45) Date of Patent: Jan. 12, 2010

(54) NON-INVASIVE THERMAL MANAGEMENT PROCESSES FOR RESTORATING METALLIC DETAILS BONDED TO SUBSTRATES

(75) Inventors: William Bogue, Hebron, CT (US); John M. Robertson, Andover, CT (US); Gary Shubert, East Hampton, CT (US)

(73) Assignee: United Technologies Corporation, Hartford, CT (US)

( * ) Notice: Subject to any disclaimer, the term of this patent is extended or adjusted under 35 U.S.C. 154(b) by 153 days.

(21) Appl. No.: 11/637,296

(22) Filed: Dec. 12, 2006

(65) Prior Publication Data

US 2008/0138511 A1 Jun. 12, 2008

(51) Int. Cl.
*B23P 6/00* (2006.01)

(52) U.S. Cl. ..... 427/142

(58) Field of Classification Search ..... 427/148
See application file for complete search history.

(56) References Cited

U.S. PATENT DOCUMENTS 5,534,371 A * 7/1996 Patel et al. ..... 430/5

5,915,743 A * 6/1999 Palma ..... 29/402.18

OTHER PUBLICATIONS

Leonard P. Connor, Welding Technology 153 American Welding Society 3rd printing (1991).*

Kurtus, Heat Transfer, http://www.school-for-champions.com/science/heat_transfer.htm (last visited Jun. 30, 2009).*

* cited by examiner

*Primary Examiner*—Roy King
*Assistant Examiner*—Yoshitoshi Takeuchi
(74) *Attorney, Agent, or Firm*—Bachman & LaPointe, P.C.

(57) ABSTRACT

A thermal management process for enabling the restoration of a surface of a metallic detail in the presence of at least one bonding material, comprising preparing at least one damaged area on a metallic detail; disposing at least one thermal management component upon a bonding material or a surface area proximate to the bonding material to which the metallic detail is joined; masking at least the surface area and the bonding material with a masking agent; and dimensionally restoring a surface of the metallic detail disposed on the article at a processing temperature lower than a temperature which would degrade the bonding material, the substrate, or the bondment interface therebetween.

20 Claims, 3 Drawing Sheets

NON-INVASIVE THERMAL MANAGEMENT PROCESSES FOR RESTORATING METALLIC DETAILS BONDED TO SUBSTRATES

FIELD OF THE INVENTION

The invention relates to restoration of metallic details bonded to a substrate, more particularly, to non-invasive thermal management processes that allow metallic details adhesively bonded to substrates to be dimensionally restored while still bonded to the substrate.

BACKGROUND OF THE INVENTION

Adhesive bonding has been long employed as a means of joining metallic details to substrates such as metallic, ceramic, wood or composite surfaces. When the metallic detail wears during use, dimensional restoration is typically achieved by breaking the adhesive bond to separate the detail from the substrate, restoring or replacing the metallic detail, and re-bonding the detail to the substrate. As illustrated in FIGS. 1A and 1B of the prior art, this process is prone to incurring damage to the substrate 10 during metallic detail 12 removal. Damage may occur such as a change of geometry 20 of the fillet 14, and/or a disbond or separation 16 at the bondment 18 of the fillet 14 and metallic detail 12. Furthermore, the metallic detail 12 often requires tooling to be correctly re-installed in the proper location and orientation on the substrate 10.

Therefore, there exists a need for a process that allows metallic details adhesively bonded to underlying substrates to be dimensionally repaired, without degrading the function of the adhesive bond, and without damaging the substrate with the heat generated during the metallic detail restoration process.

SUMMARY OF THE INVENTION

In one aspect of the present invention, a thermal management process for enabling the restoration of a metallic detail in the presence of at least one bonding material broadly comprises preparing at least one damaged area on a metallic detail; disposing at least one thermal management component upon a bonding material or a surface area proximate to the bonding material to which the metallic detail is joined; masking at least the surface area and the bonding material with a masking agent; and dimensionally restoring the metallic detail disposed on the article at a processing temperature lower than a temperature which would degrade the bonding material, the substrate, or the bondment interface therebetween.

Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1A:
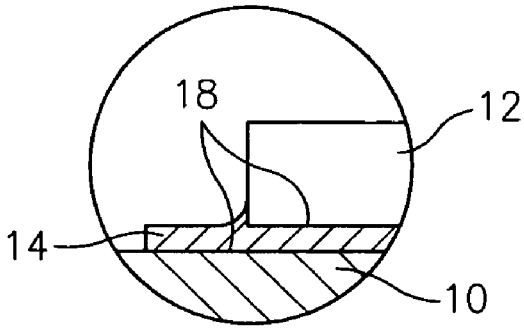
FIG. 1A (PRIOR ART)
FIG. 1A is a representation of an article of the prior art before undergoing detail removal.
Figure 1B:
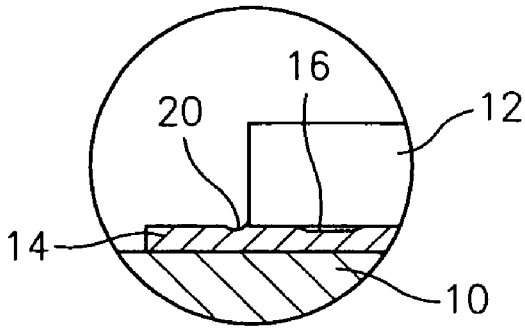
FIG. 1B (PRIOR ART)
FIG. 1B is a representation of an article of the prior art showing damage incurred to the substrate during detail removal.
Figure 2:
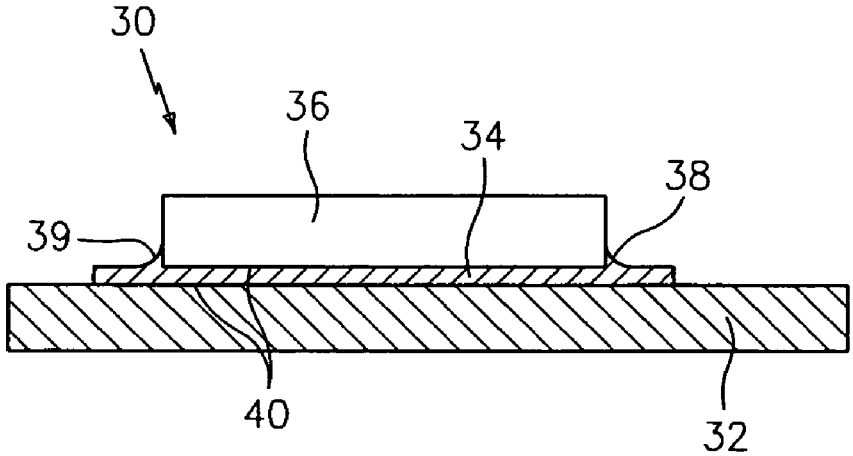
FIG. 2 is a representation of an article assembly for use in implementing the exemplary processes of the present invention.
Figure 3:
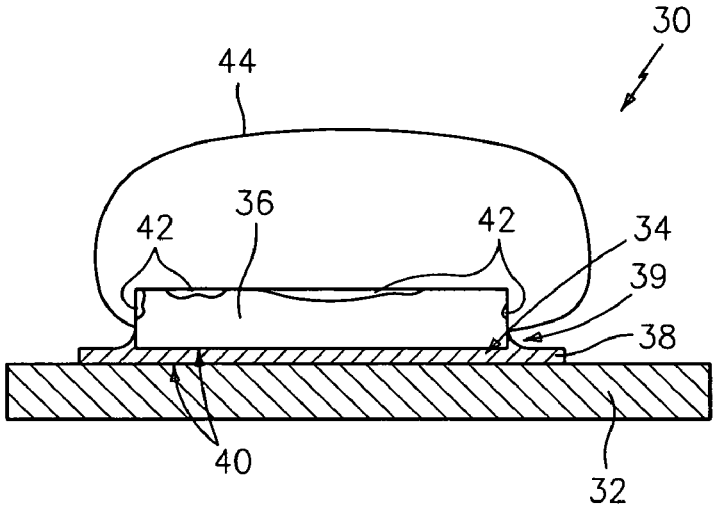
FIG. 3 is a representation of an article to be repaired using the exemplary processes of the present invention.

Referring to FIGS. 2 and 3, an article 30 comprises a substrate 32 and a metallic detail 36 attached thereto via a bonding material 34. Bonding material 34 is required in order to attach certain metallic details 36 to underlying substrates 32 composed of composite materials and/or low melting point metal alloys such as aluminum, magnesium, and the like. Typically, these metallic details 36 have a maximum service use temperature of no more than about 300° F. This maximum use temperature makes the use of common adhesives, such as urethanes, epoxies and silicones, a feasible alternative to welding. As a result, many metallic details 36 are bonded to the substrate 32 rather than being joined thereto by welding. For example, substrate 32 may be bonded to an exterior portion of the fillet 38 with a bonding material 34 at a bondment 40, the bonding interface, and a metallic detail 36 may also be bonded to an interior portion of the fillet 38 with the bonding material 34 at the bondment 40. When metallic detail 36 sustains at least one damaged area 42 of a repair area 44, the damaged feature and/or detail of metallic detail 36 may be repaired and/or dimensionally restored using an exemplary thermal management process as described herein, which avoids the need to physically separate the metallic detail 36 from the substrate 32.

Figure 4:
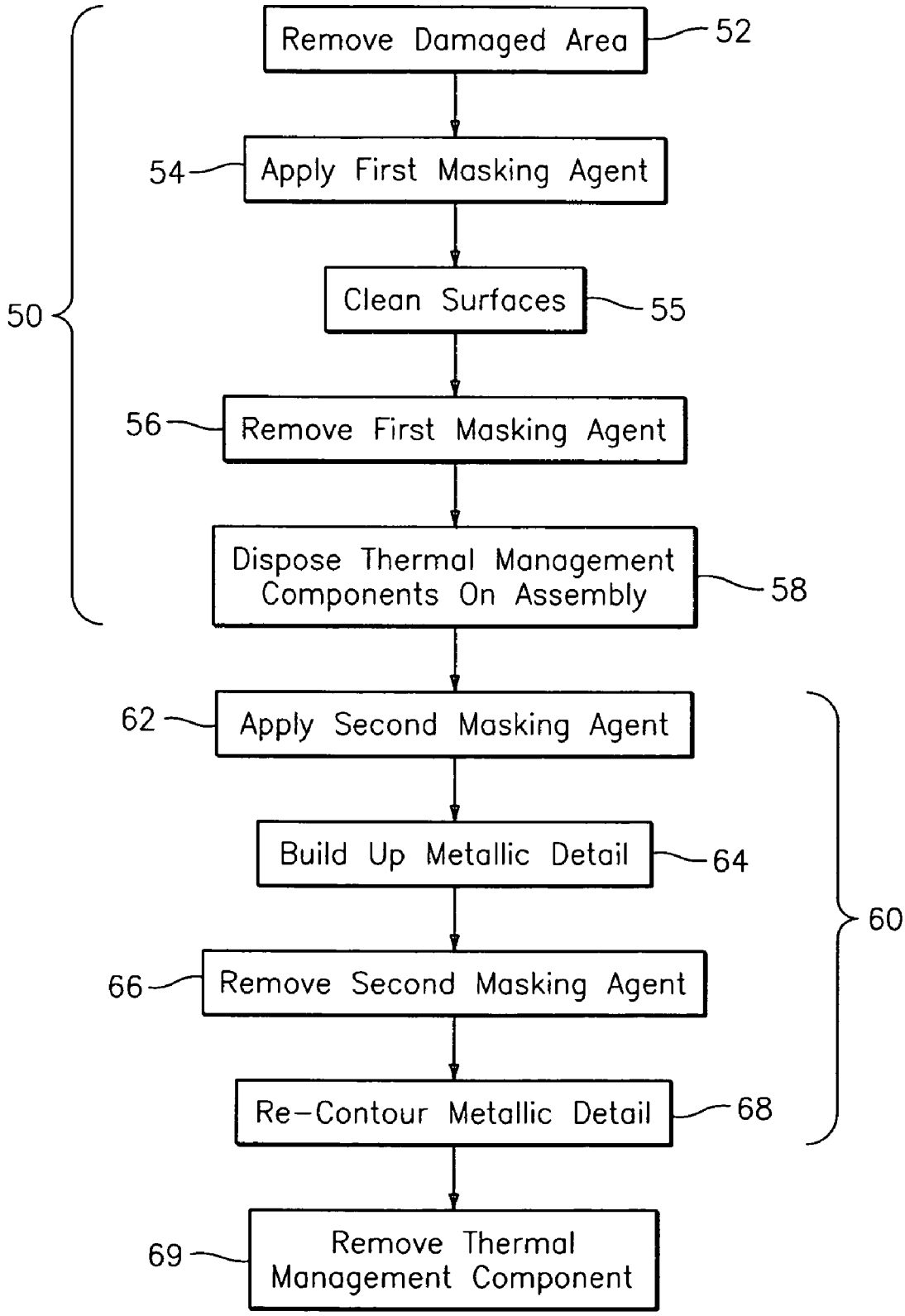
FIG. 4 is a flowchart representing an exemplary process of the present invention.

Referring now to FIG. 4, a flowchart representing a general exemplary thermal management process of the present invention for restoration of metallic details bonded to a substrate is illustrated. The exemplary thermal management processes may comprise a set of surface preparation steps 50 and a set of dimensional restoration steps 60. As known to one of ordinary skill in the art, the damaged area 42 may be prepared prior to restoring a detail and/or feature of the metallic detail 36. Typically, the preparation work may involve first removing at least a portion of the damaged area 42 of the metallic detail 36 (See FIG. 3) at step 52 of FIG. 4. The removal process may be accomplished using any suitable machining process known to one of ordinary skill in the art. Next, a first masking agent known to one of ordinary skill in the art may be applied to the article 30 at step 54 of FIG. 4. Masking may be applied to at least the exposed proximate surface area 39 of the bonding material 34 and the substrate 32. The first masking process may be accomplished using any suitable masking process known to one of ordinary skill in the art. Once the exposed bonding material 34 and surface area 39 proximate to the bonding material 34 are masked, the damaged area 42 may be cleaned using any suitable cleaning process known to one of ordinary skill in the art at step 55 of FIG. 4. For example, a grit blasting process may be used to clean the surface of the metallic detail 36 requiring dimensional restoration. Afterwards, the first masking agent may be removed at step 56 of FIG. 4 using any suitable mask removal process known to one of ordinary skill in the art.

Figure 5:
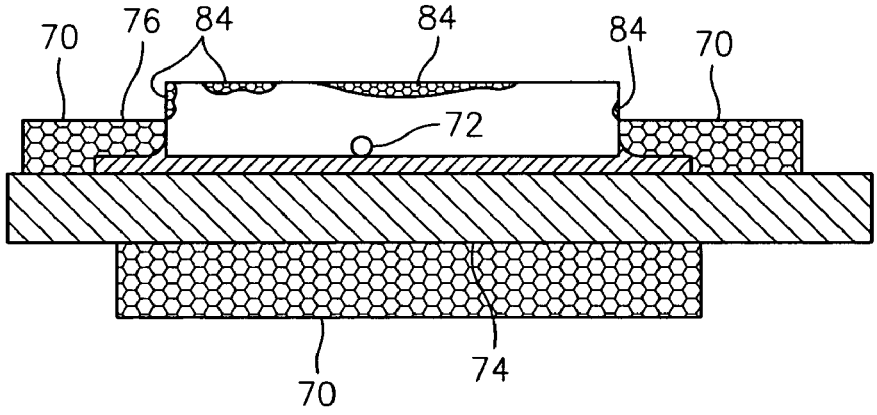
FIG. 5 is a representation of the article of FIG. 3 being repaired according to the exemplary process of the present invention.
Figure 6:
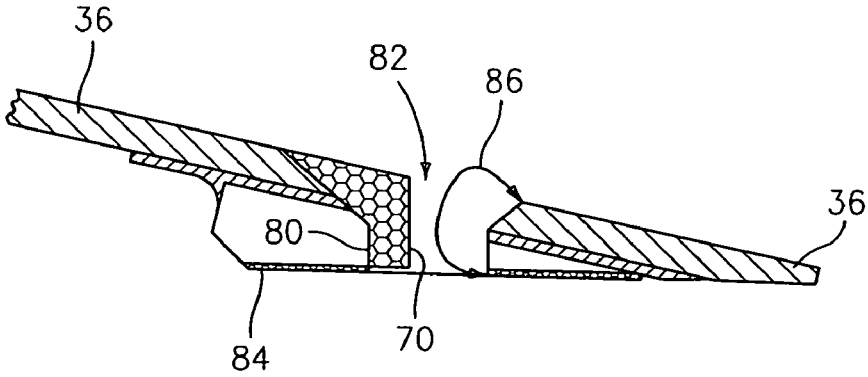
FIG. 6 is a representation of an alternate embodiment of the article of FIG. 3 illustrating an additional surface available on the article with an internal aperture such as a bolt or rivet hole.

Referring now to FIGS. 4 and 5, at least one thermal management component may be optionally disposed upon at least a portion of, substantially all of, or the entirety of a surface area 86 where the bonding material 34 and proximate surface area 39 of the article are exposed at step 58 of FIG. 4. Thermal management components such as chill blocks 70 are generally known to one of ordinary skill in the art. For example, at least one chill block 70 may be placed directly upon the surface area 39 and/or bonding material 34 as well. Optionally additional chill blocks 70 may be placed in other areas proximate to the substrate 32 and substrate surfaces substantially free of, or free of, bonding material 34, such as the substrate surface 74 opposite bonding material 34, as shown in FIG. 5. Optionally too, additional chill blocks 70 may be placed proximate to and/or upon an edge 80 of a perforation 82 on the exterior surface 86 of the metallic detail 36 and opposite a dimensionally restored area 84 as shown in FIG. 6.

Referring again to FIG. 4, once such thermal management components are in place, the dimensional restoration steps may be performed. A second masking agent or series of second masking agents as known to one skilled in the art may be applied to a surface 76 of the thermal management components 70 and the area of surface proximate to the thermal management component 70. This second masking agent provides effective protection to surface 76 and bonding material 34 to prevent or mitigate thermal degradation of the assembly 30 or its components, or of the bonding material 34, during the restoration processes.

When disposing the second masking agent at step 62 of FIG. 4, an insulation material may be disposed upon the surface area to be masked, and then a second masking agent known to one of ordinary skill in the art may be disposed upon the insulation material. Typical bonding materials approved for use in the aerospace industry are capable of withstanding temperatures of about 200° F. (93° C.) to about 600° F. (316° C.). For example, approved epoxies are thermally stable at temperatures up to about 300° F. (149° C.), silicones up to about 500° F. (260° C.), while approved polyimides can withstand operating temperatures over about 600° F. (316° C.). Generally, aerospace industry approved bonding materials that fall within the aforementioned maximum use temperature ranges include the following: epoxies, polyesters, cyanoacrylates, polyamides, polyimides, and combinations thereof. The insulation material may be any insulation material capable of withstanding temperatures higher than the adhesive or substrate, if necessary. Generally, the insulation material is present in an amount sufficient to sufficiently reduce heat flow into the adhesive bonding material 34 or substrate 32 such that the respective maximum use temperature is not exceeded.

During the exemplary processes of the present invention, the temperature of the bonding material 34, and underlying substrate 32, may be monitored using a conventional device, e.g., a thermocouple 72, or infrared thermometer, as known to one of ordinary skill in the art. For example, the thermocouple may be attached using at least one lead line (not shown) to at least the bonding material 34, and/or substrate 32, in order to monitor the temperature throughout the restoration process. Optionally, as shown in FIG. 5, the temperature indicating device may be attached to the surface of the fillet 38 which affords line of sight access for the indicating device during the dimensional restoration process. The dimensional restoration process may be slowed or terminated prior to completion if the measured temperature approaches the temperature at which the bonding material, the substrate, and/or the bondment begins to degrade, or at a predetermined temperature lower than all three of these temperatures if desired.

After masking is completed at step 62, the metallic detail 36 may be dimensionally restored or built up at step 64 of FIG. 4. Suitable metal additive processes for dimensionally restoring the metallic detail(s) 36 may include, but are not limited to, thermal spray processes, plasma vapor deposition processes, dual wire arc processes, vapor deposition processes, plating processes, weld cladding processes, and other metal additive processes known to one skilled in the art. Typically, such methods are not utilized for use with bonded assemblies because these methods generate thermal gradients at a substrate's surface that can exceed the temperatures where the physical properties of the bonding material 34, the substrate 32, or the bondment 40 therebetween degrade, or where the mismatch of the component material coefficients of thermal expansions exceed the bonding adhesive shear strength. However, the aforementioned thermal management components combined with specific operating parameters may be used to reduce the temperature at the bonding material 34, substrate 32 and the bondment 40 interfaces. Following the dimensional restoration step, the second masking agent may be removed at step 66 of FIG. 4 using any suitable mask removal process known to one of ordinary skill in the art. Afterwards, the metallic detail 36 may be re-contoured to shape and size at step 68, if necessary, using any method known to one of ordinary skill in the art which does not impart sufficient thermal energy to degrade the assembly. Lastly, the thermal management components 70 and temperature monitoring devices 72 may be removed at step 69 of FIG. 4.

The exemplary non-invasive thermal management processes for restoring bonded metallic details provides several advantages over the prior art. The processes described herein do not require separation of the metallic detail 36 from the substrate 32 or bonding material 34. Any time a firmly bonded part is removed from a substrate, the substrate risks being structurally or dimensionally damaged. In addition to potential substrate damage, the part must be realigned and re-bonded to the substrate, introducing the potential to misalign the part. Moreover, time, labor and associated costs all increase when a part must be removed from a substrate to be restored. The exemplary processes described herein eliminate the potential to both structurally damage the underlying structure and misalign the re-bonded part, and do not incur additional expenses as a result of such work.

One or more embodiments of the present invention have been described. Nevertheless, it will be understood that various modifications may be made without departing from the spirit and scope of the invention. Accordingly, other embodiments are within the scope of the following claims.

What is claimed is:

1. A thermal management process for enabling the restoration of a surface of a metallic detail in the presence of at least one bonding material, comprising:

preparing at least one damaged area on a metallic detail bonded to a composite substrate by a bonding material;

disposing at least one thermal management component upon said bonding material or a surface area of the substrate proximate to said bonding material to which said metallic detail is bonded, the thermal management component comprising at least a portion contacting the substrate, the contacting being opposite the metallic detail so that said substrate and said bonding material are between at least said portion of the thermal management component and the metallic detail;

masking at least said surface area and said bonding material with a masking agent; and dimensionally restoring a surface of said metallic detail at a processing temperature lower than a temperature of degradation of said bonding material, said substrate, and a bondment interface therebetween.

2. The process of claim 1, wherein disposing comprises placing at least one thermal management component upon said bonding material and said surface area proximate to said bonding material to which said metallic detail is bonded.

3. The process of claim 1, further comprising monitoring a temperature of at least said bonding material or substrate.

4. The process of claim 3, wherein monitoring comprises using a temperature indicating device.

5. The process of claim 4, wherein said temperature indicating device is a thermocouple or an infrared thermometer.

6. The process of claim 1, wherein dimensionally restoring comprises using a metal additive process to build up said surface of said metallic detail and then contouring said built up surface of said metallic detail.

7. The process of claim 6, wherein said metal additive process comprises any one of the following processes: a plasma spray process, a thermal spray process, a dual wire arc spray process, a vapor deposition process, a plating process, and a weld cladding process.

8. The process of claim 1, wherein dimensionally restoring comprises dimensionally restoring at least one feature of said metallic detail.

9. The process of claim 1, wherein preparing comprises the steps of:

removing at least a portion of a damaged area from said metallic detail;

masking at least said bonding material and said surface area with a first masking agent;

cleaning said portion; and removing said first masking agent.

10. The process of claim 1, wherein masking comprises masking at least said surface area and said bonding material with a second masking agent.

11. The process of claim 10, further comprising removing said second masking agent after dimensionally restoring said surface of said metallic detail.

12. The process of claim 1, further comprising removing said at least one thermal management component after completing said dimensional restoration step.

13. The process of claim 1, wherein disposing further comprises disposing said at least one thermal management component upon or proximate to a fillet to which said metallic detail is bonded.

14. The process of claim 1, wherein disposing further comprises disposing said at least one thermal management component upon a surface of said substrate substantially free of said bonding material.

15. The process of claim 1, wherein masking further comprises masking said at least one thermal management component with said masking agent.

16. The process of claim 1, wherein masking further comprises masking a fillet to which said metallic detail is bonded.

17. The process of claim 1, wherein said bonding material comprises any one of the following: epoxies, polyesters, cyanoacrylates, polyamides, polyimides, and combinations thereof.

18. A method for restoring a surface of a metallic detail bonded to a substrate by a bonding material, a hole extending though the substrate, the bonding material, the method comprising:

placing at least one thermal management component upon the bonding material or a surface of the substrate proximate to the bonding material so as to extend through the hole, contacting the substrate, the bonding material, and the metallic detail; and dimensionally restoring the surface of the metallic detail at a processing temperature lower than a temperature of degradation of the bonding material, the substrate, and a bonding interface therebetween.

19. The method of claim 18, wherein the thermal management component contacts the substrate opposite said surface of the metallic detail.

20. The method of claim 18 wherein:

said metal additive process comprises any one of the following processes: a plasma spray process, a thermal spray process, a dual wire arc spray process, a vapor deposition process, a plating process, and a weld cladding process; and said bonding material comprises any one of the following: epoxies, polyesters, cyanoacrylates, polyamides, polyimides, and combinations thereof.

* * * * *